United States Patent [19]

Gaskins

[11] 4,409,864

[45] Oct. 18, 1983

[54] BOTTLE OPENER

[76] Inventor: Thomas Gaskins, Cypress Knee Museum, Palmdale, Fla. 33944

[21] Appl. No.: 368,022

[22] Filed: Apr. 12, 1982

[51] Int. Cl.[3] ..... B67B 7/16

[52] U.S. Cl. ..... 81/3.46 R; 81/3.3 A

[58] Field of Search ..... 81/3.46 R, 3.3 R, 3.3 A, 81/3.34

[56] References Cited

U.S. PATENT DOCUMENTS

| | | | |
|---|---|---|---|
| 521,752 | 6/1894 | Abbott | 81/3.46 R |
| 1,307,519 | 6/1919 | Scarborough | 81/3.46 R |
| 2,005,784 | 6/1935 | Harvey | 81/3.46 R |
| 2,044,129 | 6/1936 | Soukup | 81/3.46 A |
| 2,106,639 | 1/1938 | Jenkinson | 81/3.46 R |
| 2,576,000 | 11/1951 | Cowan, Jr. | 81/3.46 R |
| 2,612,800 | 10/1952 | Dreier | 81/3.46 R |

*Primary Examiner*—Roscoe V. Parker

*Attorney, Agent, or Firm*—Mason, Fenwick & Lawrence

[57] ABSTRACT

A bottle opener includes a handle and a unitary rod-like member on the handle including a pair of cantilever arms extending outwardly from the handle; a lift arm extends transversely from each cantilever arm and lift hook means on the end of each lift arm. In use, the cantilever arm can extend over the upper surface of a bottle cap on a bottle with the left arm extending downwardly along the side of the bottle cap to position the lift hook beneath the peripheral lip of the bottle cap so that relative tilting movement between the handle and the bottle causes the lift hook to forcefully engage the bottle cap to lift it from the bottle. Alternative embodiments are wall mounted or counter mounted.

4 Claims, 8 Drawing Figures

Fig-1
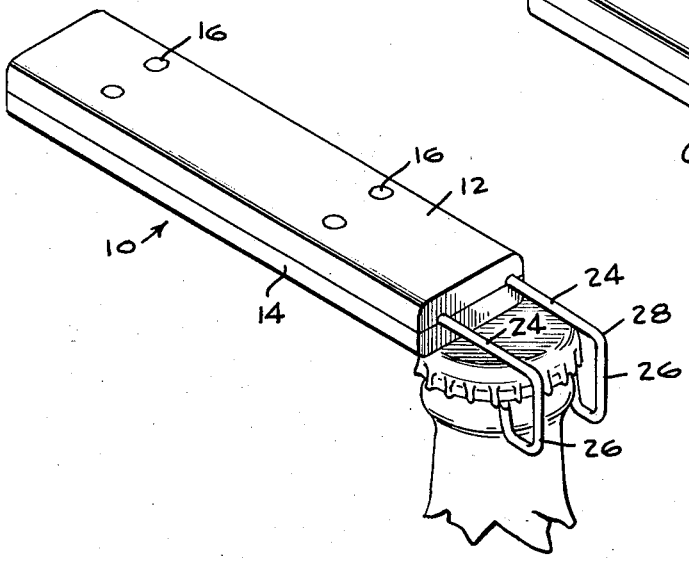
Fig-2
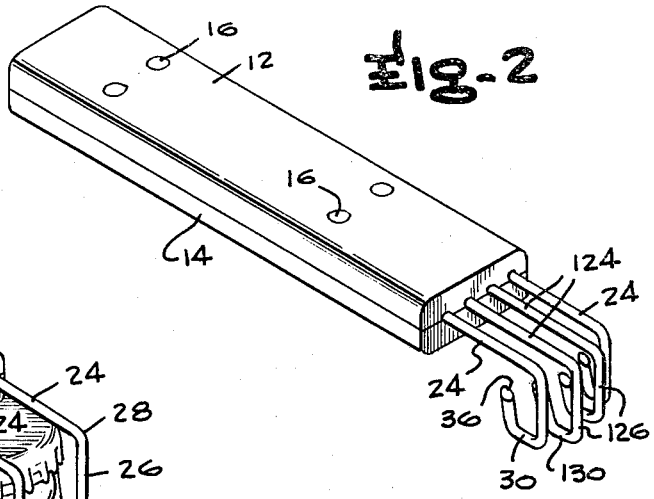
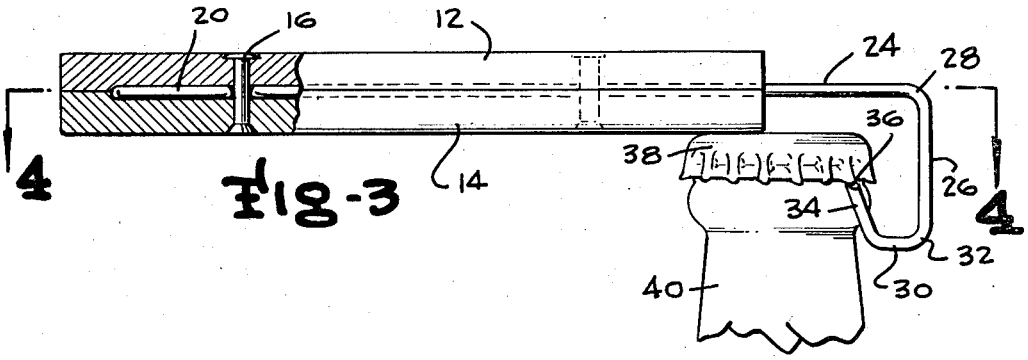
Fig-3
Fig-4
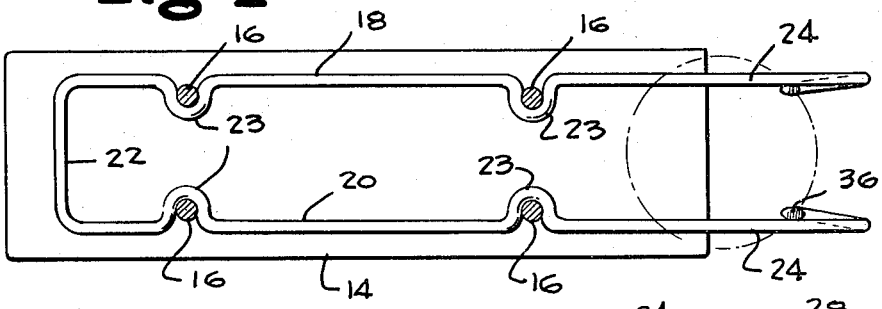
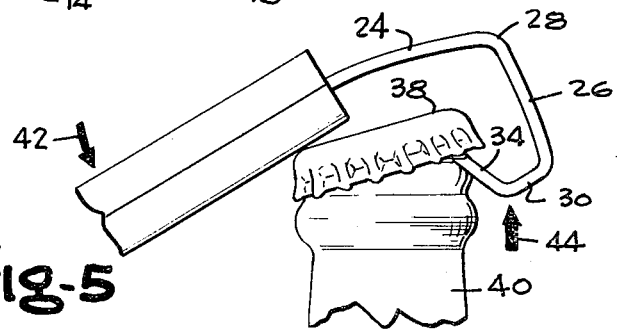
Fig-5

BOTTLE OPENER

BACKGROUND OF THE INVENTION

The present invention is directed to the field of bottle cap removers and is more specifically directed to a unique bottle cap remover or bottle opener, as they are frequently referred to, which is easy to use and which is unlikely to cause damage to the bottles from which caps are removed by the subject device. It is a well-known problem in the art of bottle cap removers that many of such currently known devices frequently break the lip of the bottle and are difficult to use. It is the solution of these problems to which the present invention is directed.

SUMMARY OF THE INVENTION

Therefore, it is the primary object of this invention to provide a new and improved bottle cap opener.

Achievement of the foregoing object is enabled by the provision of a bottle cap opener employing a support handle supporting a pair of cap engaging members. Each of which cap engaging member includes a cantilever arm having a downwardly extending lift arm, an inwardly curved intermediate portion, and a first hook arm extending horizontally and a hook tooth extending upwardly from the inner end of the hook arm with the upper end of the hook tooth being engageable with the underside of a bottle cap. The upper end of each hook tooth is canted so as to provide a relatively sharp curved upper edge surface which can shift laterally into the fluted portions of the cap so as to gain an optimum holding contact with the cap so that pivotal movement relative to the hook members effects removal of the bottle cap. In one aspect of the invention, the cantilever arms extend outwardly from a handle member with at least two hook teeth being provided for engaging the bottle cap. In another aspect of the invention, a plurality of four hook teeth are provided to extend forwardly from the handle for engaging the bottle cap. Other embodiments employ basically the same type of cap engaging structure mounted either on a vertical wall or underneath a counter top.

BRIEF DESCRIPTION OF THE DRAWINGS

FIG. 1 is a perspective view illustrating usage of the preferred embodiment of the invention in connection with the removal of a bottle cap from a bottle;

FIG. 2 is a perspective view of an alternative embodiment of the invention;

FIG. 3 is a side elevational view partially in section of the embodiment illustrated in FIG. 1;

FIG. 4 is a sectional view taken along lines 4—4 of FIG. 3;

FIG. 5 is a side elevational view similar to FIG. 3 but illustrating a subsequent positioning of the preferred embodiment from the position of FIG. 3 with the preferred embodiment removing the cap from the bottle top;

DESCRIPTION OF THE PREFERRED EMBODIMENTS

Figure 6:
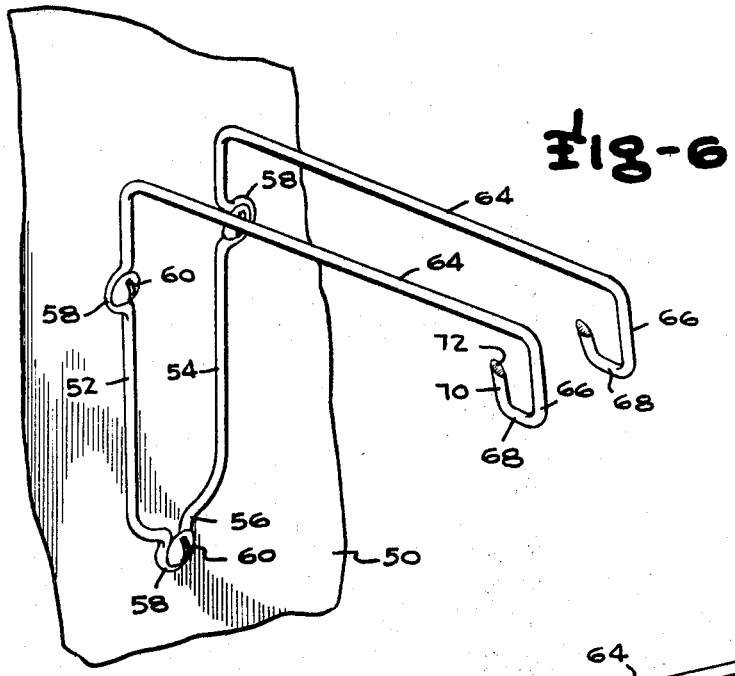
FIG. 6 is a perspective view of an alternative wall-mounted embodiment of the invention.

FIG. 1 illustrates a first embodiment of the invention comprising a handle member 10 formed of an upper handle half 12 and a lower handle half 14 held together with rivets or the like 16. Grooves are provided in the facing surfaces of the upper handle half 12 and the lower handle half 14 for retaining bottle cap engaging means held therebetween. More specifically, the cap engaging member comprises a unitary steel member including a U-shaped portion consisting of side legs 18 and 20 and a base portion 22. The side legs include curved indentations 23 extending inwardly around the rivet members 16 as best shown in FIG. 4. The outer ends of the side legs 18 and 20 extend in a cantilever manner from the handle 10 so as to define two cap engaging members each consisting of a cantilever arm 24 oriented in horizontal manner when held in the position illustrated in FIGS. 1 and 3. It should be noted at this juncture that the terms "horizontal" and "vertical" are used in the sense of the orientation of the item as shown in FIGS. 1 and 3; however, the item is obviously capable of positioning in any desired position and the terms "horizontal" and "vertical" consequently refer to relative perpendicular directions for any particular orientation.

A lift arm 26 extends downwardly from the outer end of each cantilever arm 24 and is joined thereto by a curved intermediate portion 28. A lift hook is unitarily connected to and extends from the lower end of lift arm 26 and comprises a first hook arm 30 which extends horizontally and transversely from a lower curved connector portion 32 joining the lower end of lift arm 26 and a hook tooth 34 extending at a canted angle upwardly from the first hook arm 30. It should be observed that the outer end of the hook tooth is defined by a canted surface 36 so as to define a relatively sharp upper edge terminal which is positionable under the fluted edge of a bottle cap 38 on a bottle 40. The device is used by positioning the upper ends of the hook tooth 34 as shown in FIG. 3 following which the handle is rotated downwardly in the direction of arrow 42 in FIG. 5 so as to fulcrum the handle about the edge of the cap 38 and provide a lifting force in the vertical direction of arrow 44 so as to remove the cap from the bottle in the manner shown in FIG. 5. There is sufficient flexibility to permit slight lateral shifting of the upper ends 36 so as to enter the flutations of the cap to permit retention therein.

The embodiment illustrated in FIG. 2 is identical to the embodiment of FIGS. 1 and 3 through 5 but differs in that two additional cantilever arms 124 of longer length than the cantilever arms 24 are positioned intermediate the cantilever arms 24 to provide additional bottle cap engaging members having outer lift arms 126 and hook arms 130 basically identical to the corresponding elements 26 and 30 of the first embodiment. The inner ends of the cantilever arms 124 are held within handle members 14 and 12 in the same manner as elements 18, 20, etc. of the first embodiment. In operation, the second embodiment is used in essentially the same manner as the first embodiment but provides additional contact and lifting force with the bottle cap by virtue of the two additional cap engaging lift hook members.

Figure 7:
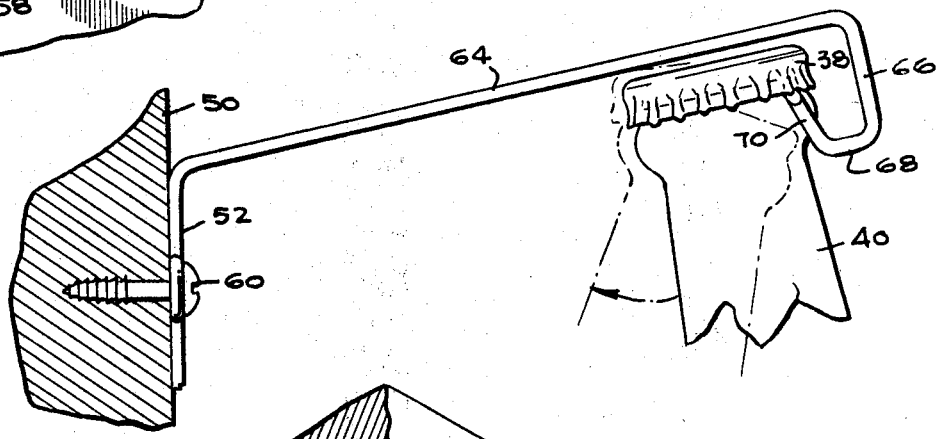
FIG. 7 is a side elevation view of the embodiment of FIG. 6.

FIGS. 6 and 7 illustrate an alternative embodiment in which the cap remover is mounted on a vertical wall 50.

The bottle opener of the embodiment of FIGS. 6 and 7 consists of a unitary steel member including a U-shaped portion including side legs and a base portion 56 each of which includes a semi-circular portion 58 fitted about a mounting screw 60. Cantilever arms 64 extend forwardly from the upper ends of the side legs 52 and 54 and have lift arms 66, hook arms 68, and hook teeth 70 having canted end surfaces 72 on their outer ends. In operation, the embodiment of FIGS. 6 and 7 is used by positioning a bottle 40 in the solid-lined position shown in FIG. 7 following which the bottle is pivoted in a clock-wise direction so as to effect removal of the bottle cap 38.

Figure 8:
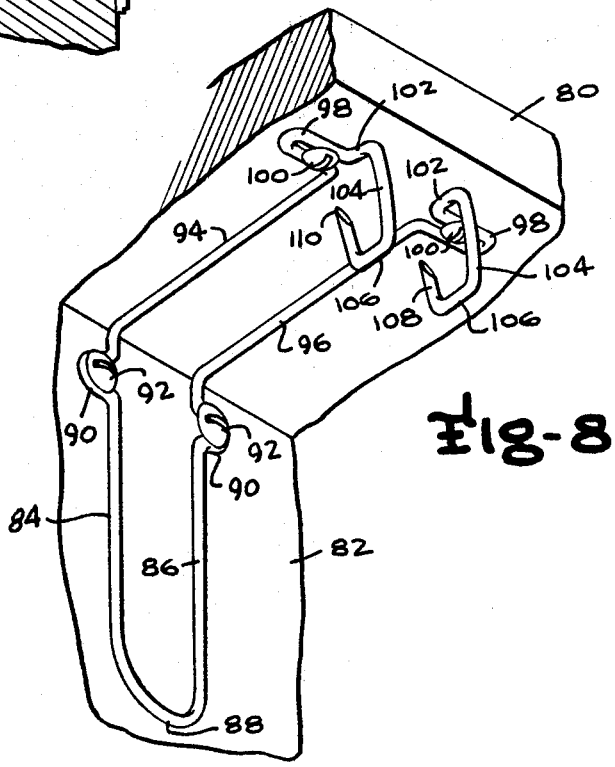
FIG. 8 is a bottom perspective view of a further embodiment mounted beneath a counter top.

FIG. 8 illustrates a third embodiment of the invention which is mounted beneath a counter top 80 on a vertical wall 82 and which includes a U-shaped portion having side legs 84 and 86 and a base 88 with semi-circular portions 90 encircling mounting screws 92 on the vertical wall and with forwardly extending counter engaging arms 94 and 96 extending forwardly perpendicularly from the upper ends thereof. Elongated mounting slot defining portions 98 are provided at the outer ends of arms 94 and 96 and receive mounting screws 100. Cantilever arms 102 extend outwardly from the mounting slot portions 98 and have lift arms 104 extending downwardly from their outer ends. Hook arms 106 extend rearwardly from the lower end of lift arms 104 and a hook tooth 108 having a canted end surface 110 are mounted on the inner ends of the hook arms 106. It should be understood that the elements 104, 106, and 108 are basically identical to the elements 26, 30, and 34 of the first embodiment. In use, a bottle cap is positioned with its inside lower edge engaged by the upper ends 110 of the hook teeth and the bottle is pivoted in a clockwise direction similar to the pivoting of the bottle in FIG. 7 so as to effect a lifting removal of the cap from the bottle.

Thus, it will be seen that all embodiments of the present invention provide a unique method of engaging and removing a bottle cap with a minimum possibility of damage to the bottle. Moreover, the operation of each of the devices is both effective and easy to accomplish so as to render use of all embodiments convenient to users. While preferred embodiments of the invention have been disclosed, it should be understood that the spirit and scope of the invention is to be limited solely by the appended claims since numerous modifications of the disclosed embodiments will undoubtedly occur to those of skill in the art.

I claim:

1. A bottle opener comprising:

a handle member; and a cap engaging member mounted on said handle member and including a cantilever arm extending outwardly from said handle member, a lift arm extending substantially perpendicularly from said cantilever arm and lift hook means on an end of said lift arm comprising a hook arm extending transversely from said lift arm and an outer hook tooth extending transversely from said hook arm toward said cantilever arm and having a canted upper end surface defining an upper pointed edge positionable against a bottle under a flute of a bottle cap with the canted surface engaging the inner surface of the cap and wherein said outer hook tooth, said lift arm, and said hook arm and said cantilever arm are unitarily formed of metal and wherein said cantilever arm, said lift arm, said first hook arm and said outer hook tooth are dimensioned so that said cantilever arm can extend over the upper surface of a bottle cap on a bottle with the lift arm extending downwardly along the side of the bottle cap to position the upper pointed edge of the outer hook tooth beneath the peripheral lip of the bottle cap so that relative tilting movement between the handle member and the bottle causes the canted upper end surface to forcefully engage the bottle cap to cam it outwardly and upwardly to lift same from the bottle.

2. The bottle opener of claim 1 wherein a plurality of said cap engaging members of substantially identical construction extend from said handle member.

3. The bottle opener of claim 1 wherein said cantilever arm, said lift arm, said first hook arm, and said outer hook tooth are formed of metal which is sufficiently flexible to permit the outer hook tooth to shift laterally to best move into the corrugation flutes of a bottle cap.

4. The bottle opener of claim 3 wherein a plurality of said cap engaging members of substantially identical construction extend from said handle member.

* * * * *